United States Patent [19]

Giebel

[11] 4,040,376

[45] Aug. 9, 1977

[54] COMPLETELY EXPENDABLE MINE ANCHOR LINE CUTTING TOOL

[75] Inventor: Joseph L. Giebel, Pittsburgh, Pa.

[73] Assignee: Mine Safety Appliances Company, Pittsburgh, Pa.

[21] Appl. No.: 702,912

[22] Filed: July 6, 1976

[51] Int. Cl.[2] ..... B63B 9/00

[52] U.S. Cl. ..... 114/221 A; 30/180; 114/221 R

[58] Field of Search ..... 30/180, 228, DIG. 4; 114/221 R, 221 A

[56] References Cited

U.S. PATENT DOCUMENTS

| | | | |
|---|---|---|---|
| 3,605,673 | 9/1971 | Temple | 114/221 A |
| 3,793,978 | 2/1974 | Temple | 114/221 A |

*Primary Examiner*—Trygve M. Blix

*Assistant Examiner*—D. W. Keen

*Attorney, Agent, or Firm*—Brown, Murray, Flick & Peckham

[57] ABSTRACT

A mine anchor line cutter is slidable lengthwise of a cutter body provided with a bore behind the cutter for receiving an explosive charge that is detonated by the mine anchor line that is to be cut, whereby to drive the cutter forward. The cutter body is supported by a stabilizing fin, the front portion of which is overlapped by a retaining member shaped to hook over a sweep line. Extending through the retaining member and fin and into the cutter body is a shear screw that connects them together but that is weak enough to be sheared off by movement of the cutter body rearwardly, due to recoil when the tool is fired, whereby all of the tool will separate from the sweep line supporting it.

4 Claims, 5 Drawing Figures

COMPLETELY EXPENDABLE MINE ANCHOR LINE CUTTING TOOL

Mine anchor line cutting tools are old and well known. Such a tool includes a cutter or chisel that is driven foward through a mine anchor line by an explosive charge that is fired when the tool, drawn through water by a sweep line, hooks onto the anchor line. The cutter and the anvil of the tool separate from the rest of the tool and are lost. In some tools the housing or body for the cutter and the firing mechanism also separate from the stabilizing fin and are lost, but the fin remains attached to the sweep line, which is undesirable.

It is among the objects of this invention to provide a mine anchor line cutting tool in which all parts of the tool separate from the sweep line when the tool is fired, and in which the recoil of the tool when it is fired serves as the separating force.

The preferred embodiment of the invention is illustrated in the accompanying drawings, in which FIG. 1 is a plan view;

Figure 2:
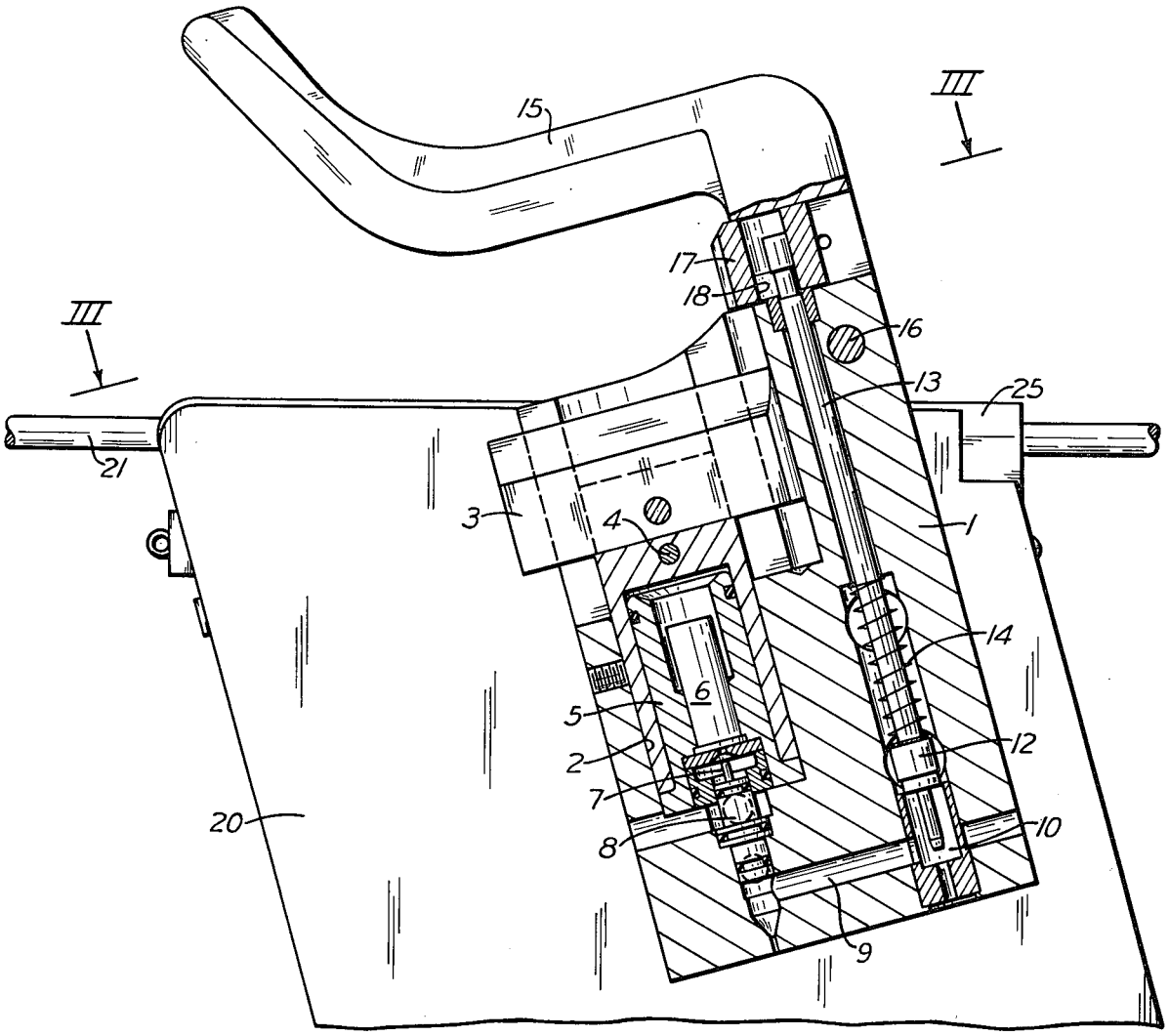
FIG. 2 is a bottom view with the cutter body shown in section.
Figure 3:
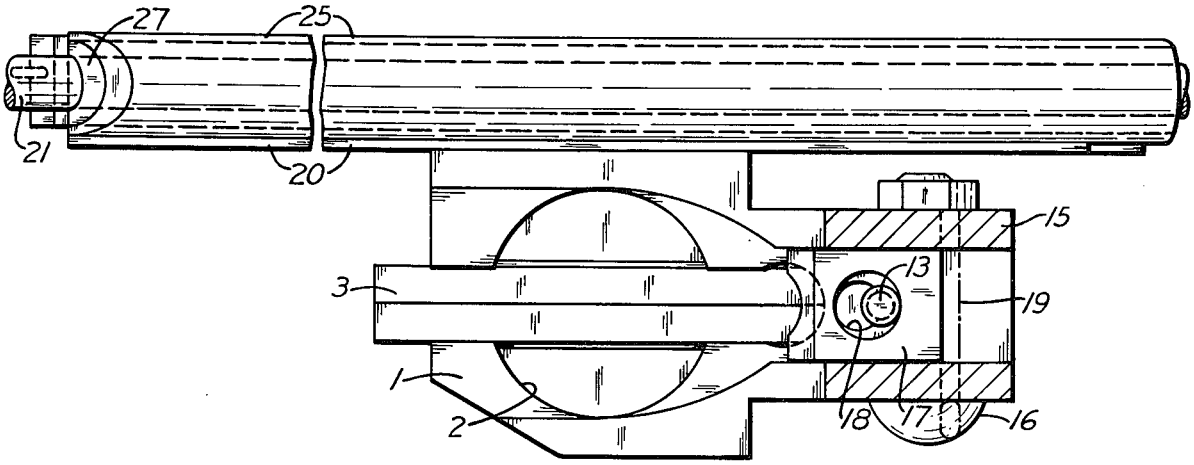
FIG. 3 is an enlarged cross section taken on the line III—III of FIG. 2.

Referring to FIG. 2 of the drawings, the mine anchor line cutting tool includes a metal cutter body 1 that has front and rear ends. Body 1 is provided with a barrel 2 that extends rearwardly into it from its front end. Slidably disposed within this barrel is the rear end portion of a cutter 3 capable of cutting a mine anchor line, such as a cable or chain. The cutter normally is held in a retracted position by a shear pin 4 extending through it and the cutter body. The portion of the cutter in the barrel is provided with a fowardly extending bore, in which a hollow cartridge housing 5 is received. Disposed in this housing is an explosive cartridge 6, and spaced from its base or rear end is a firing pin 7 mounted on the front end of a psiton 8 in a small bore in the cutter body behind the barrel. Behind this piston the bore is connected by a lateral passage 9 with a chamber 10 in the back of the body. At the front end of this chamber there is a plunger 12 mounted on the rear end of a rod 13 that is slidably mounted in the cutter body and urged rearwardly by a coil spring 14 encircling the rod. The front end of the rod extends into a slot in an anvil 15, which is connected to the cutter body by a shear bolt 16. In the slot there is a sliding trigger 17 provided with a passage throught it, at the rear end of which there is a key hole slot 18, also shown in FIG. 3. The larger end of this slot is large enough for the rod to extend through it. The rod is provided with a short portion of reduced diameter that normally fits in the narror part of the key hole slot. In this way the rod is held in its foward position against the compression of the coil spring. The trigger is prevented by a removable saftety pin 19, shown in dotted lines in FIGS. 3 and 4, from being moved accidently, but this pin is pulled out and discarded before the tool is placed in the water. To support the cutter body and cutter, they are mounted on a stabilizing fin 20 that is attached to a sweep line 21, by which the tool is pulled through water by means of a ship in the usual manner.

When a mine anchor line enters the space between the front end of the cutter body and the anvil, it pushes the slide toward adjacent side of the body and this releases the rod so that plunger 12 is driven rearwardly into chamber 10. This action forces water through passage 9 and against the rear end of piston 8 to cause it to drive the firing pin against the cartridge in order to fire it. The force of the explosion shears off pin 4 and drives the cutter foward through the mine anchor line. The description thus far is of a construction that is not new with this invention.

Figure 1:
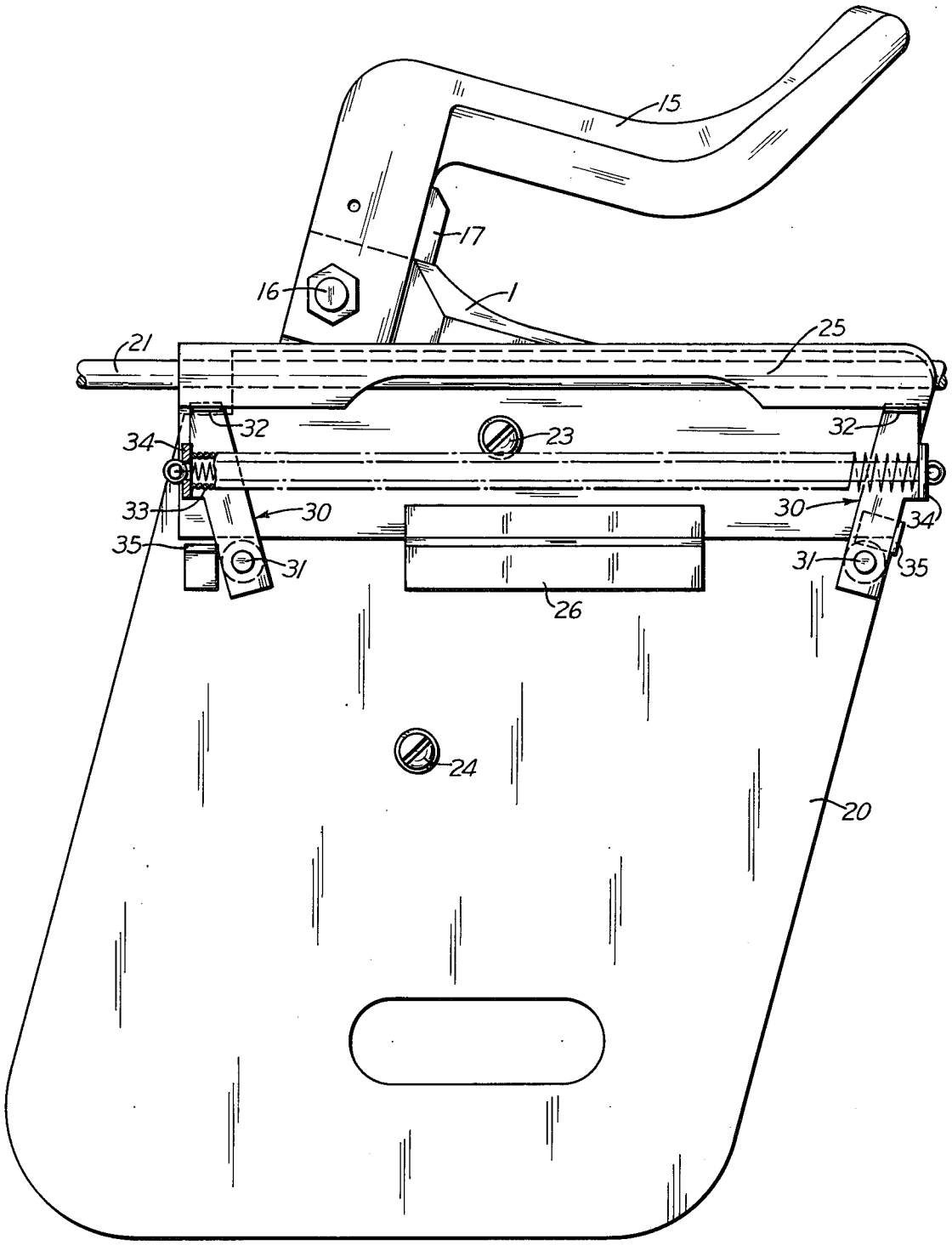
Figure 4:
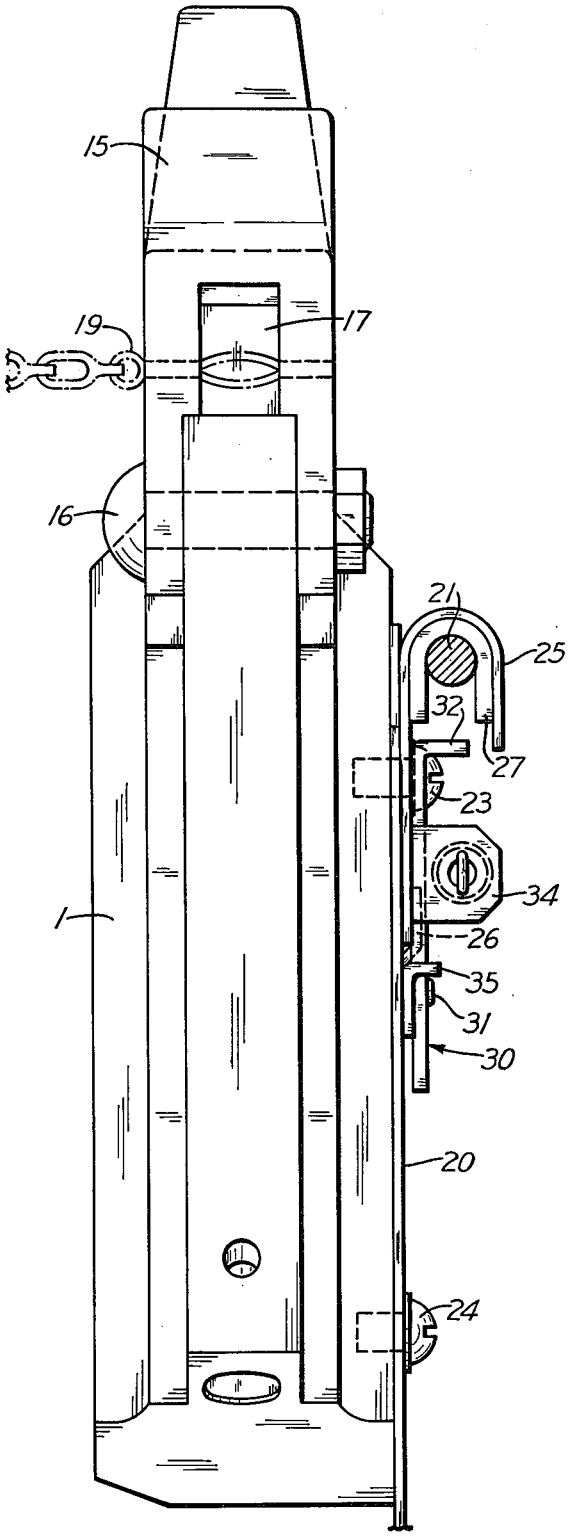
FIG. 4 is a view of the left-hand side of the tool in FIG. 1.

In accordance with this invention, the cutter body and fin are connected together by two screws 23 and 24 extending through fin and threaded in the body as shown in FIGS. 1 and 4. A retaining member 25 overlaps the front portion of the fin and is shaped to hook over the sweep line. Preferably, this member is a hook-shape plate that extends across the side of the fin opposite to the cutter body. The foward screw 23 extends through the central portion of this plate to attach it to the fin. The rear end of the plate may be overlapped by a plate 26 secured to the fin to help hold the retaining member in place. The inside of the hook may be provided with a liner 27 that will directly engage the sweep line.

As shown in FIGS. 1 and 4, the sweep line is held in the hook by means of a pair of brackets 30 near the opposite side edges of the fin. The rear ends of these brackets are pivotally connected to the fin by pins 31, and their front ends are bent outwardly away from the fin to provide lugs 32 that will prevent a sweep line from coming out of the hook. The two brackets normally are held in operative position by a solid coil spring 33, the opposite ends of which are attached to lugs 34 integral with the side of the brackets and extending away from the fin. Movement of the two brackets away from each other is limited by stops 35 secured to the fin. In order to retract the bracket lugs 32 so that the tool an be hooked onto a sweep line, the central portion of the spring is grasped and pulled toward the rear end of the fin. This causes the front ends of the brackets to swing toward each other far enough to permit the hook to be placed over a sweep line. Then the spring is released, whereupon it straightens itself and swings the brackets away from each other into operative position.

Figure 5:
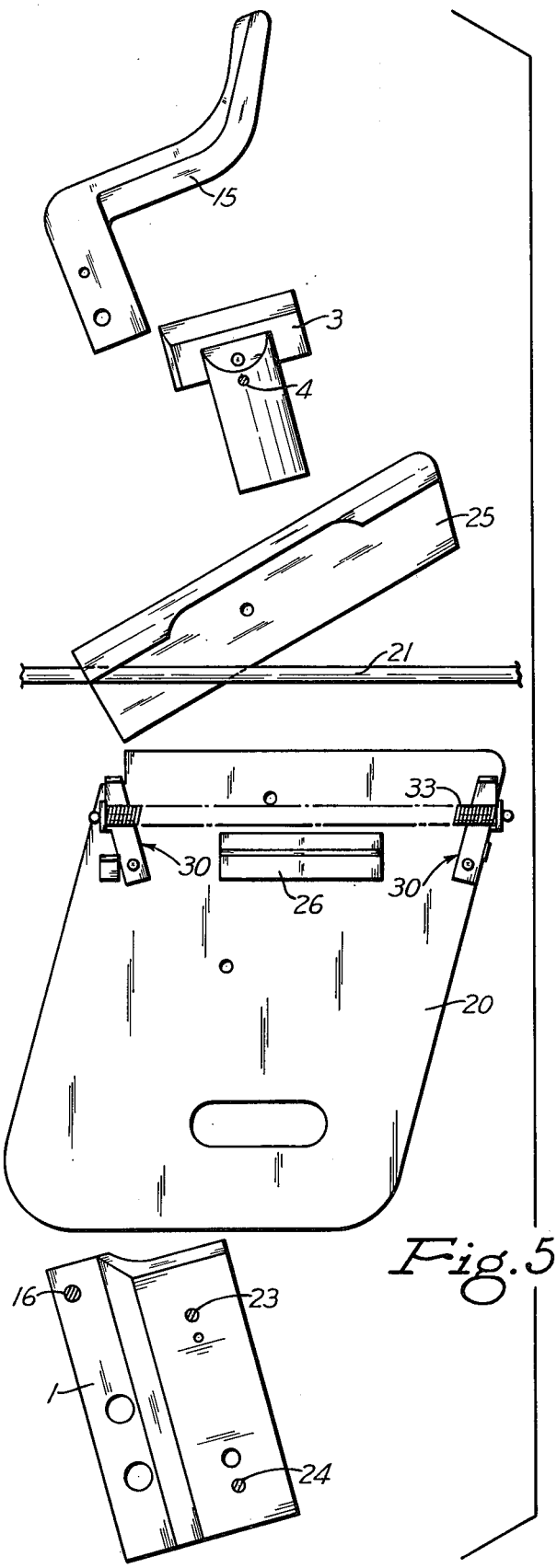
FIG.5 is a reduced plan view showing the tool parts separating from the sweep line after the tool has been fired.

When this tool encounters a mine anchor line as the tool is drawn through the water by the sweep line, the anchor line fires the tool as previously explained, which severs the line. The force of the explosion that drives the cutter 3 foward causes the cutter body 1 to recoil. Since the fin is hooked onto the sweep line, it cannot move rearwardly with the cutter body. The two screws 23 and 24 that connect the fin and cutter body are weak enough to be sheared off by the recoiling body, and this not only releases it from the fin but also releases the fin from the hook. The hook then falls away from the sweep line. It will be seen that as a result of firing the tool, the entire tool separates from the sweep line and is lost, leaving the sweep line clear. This is illustrated in FIG. 5.

According to the provisions of the patent statutes, I have explained the principle of my invention and have illustrated and described what I now consider to represent its best embodiment. However, I desire to have it understood that, within the scope of the appended claims, the invention may be practiced otherwise than as specifically illustrated and described.

I claim:

1. A completely expendable mine anchor line cutting tool comprising a cutter body having front and rear ends, a cutter therein slidable lengthwise of said body, the body having a bore behind the cutter for receiving an explosive charge, means attached to said body for receiving and holding a mine anchor in front of said cutter, means adapted to be actuated by said line for firing an explosive charge in said bore to drive the cutter foward through the line, a stabilizing fin disposed at one side of the cutter body, a retaining member overlapping the front portion of the fin and shaped to hook over a sweep line, a shear screw extending through said retaining member and fin and into the cutter body to connect them together, and means carried by the fin for locking the retaining member on a sweep line, said screw being week enough to be sheared off by movement of said body rearwardly relative to the fin due to recoil when the tool is fired, whereby all of said tool will separate from a sweep line supporting it.

2. A completely expendable mine anchor line cutting tool according to claim 1, including a second shear screw extending through said fin behind said first-mentioned screw and into said cutter body.

3. A completely expendable mine anchor line cutting tool according to claim 1, in which said retaining member is a hook-shape plate that extends across said fin and is disposed against the side of said fin opposite to said cutter body, said screw extends through the central portion of the plate, and said tool includes holding means rigidly mounted on the fin behind said plate and overlapping the rear portion of the plate.

4. A completely expendable mine anchor line cutting tool according to claim 1, in which said retaining member is a hook-shape plate that extends across said fin, said locking means including a pair of stops pivotally mounted on said fin behind said plate and extending foward to hold the hook- shape plate on a sweep line, and manually operable means normally holding said stops in locking position but permitting them to be swung away from that position to allow said plate to be hooked onto a sweep line.

* * * * *